US009254672B2

(12) United States Patent
Campbell-Brown et al.

(10) Patent No.: US 9,254,672 B2
(45) **Date of Patent: *Feb. 9, 2016**

(54) VENT THROUGH A PRINTHEAD SUPPORT STRUCTURE

(75) Inventors: Iain Campbell-Brown, Naas (IE); Eugene Cahill, Kells (IE); William S Osborne, Camas, WA (US); Anoop Haridasan, Leixlip (IE); Ivor Cummins, Dublin (IE)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/373,524

(22) PCT Filed: Mar. 19, 2012

(86) PCT No.: PCT/US2012/029608

§ 371 (c)(1),
(2), (4) Date: Sep. 19, 2014

(87) PCT Pub. No.: WO2013/141836

PCT Pub. Date: Sep. 26, 2013

(65) Prior Publication Data

US 2015/0042730 A1 Feb. 12, 2015

(51) Int. Cl.
*B41J 2/175* (2006.01)
*B41J 2/14* (2006.01)

(52) U.S. Cl.
CPC ..... *B41J 2/17523* (2013.01); *B41J 2/14* (2013.01); *B41J 2/1752* (2013.01); *B41J 2/17513* (2013.01); *B41J 2/17553* (2013.01); *B41J 2202/02* (2013.01)

(58) Field of Classification Search
USPC ..... 347/7, 49, 66, 85, 86
See application file for complete search history.

(56) References Cited

U.S. PATENT DOCUMENTS

| | | | | |
|---|---|---|---|---|
| 4,806,032 | A | 2/1989 | Gragg et al. | |
| 5,363,130 | A * | 11/1994 | Cowger et al. | 347/92 |
| 5,877,795 | A | 3/1999 | Gragg et al. | |
| 5,933,175 | A * | 8/1999 | Stathem et al. | 347/87 |
| 6,250,750 | B1 | 6/2001 | Miyazawa et al. | |
| 6,264,316 | B1 | 7/2001 | Chino | |
| 6,283,576 | B1 | 9/2001 | Premnath et al. | |
| 6,523,945 | B2 * | 2/2003 | Powers et al. | 347/86 |
| 6,733,115 | B2 | 5/2004 | Santhanam et al. | |
| 7,185,976 | B2 * | 3/2007 | Inoue et al. | 347/86 |
| 7,354,143 | B2 * | 4/2008 | Nishida et al. | 347/85 |
| 8,002,398 | B2 | 8/2011 | Pearson et al. | |
| 8,684,505 | B2 * | 4/2014 | Campbell-Brown et al. | 347/86 |
| 2003/0142180 | A1 | 7/2003 | Gonzalez | |
| 2005/0029306 | A1 | 2/2005 | Brennan | |
| 2010/0283822 | A1 | 11/2010 | Arnold et al. | |
| 2011/0050820 | A1 | 3/2011 | Foster et al. | |

FOREIGN PATENT DOCUMENTS

| | | |
|---|---|---|
| JP | 11129492 | 5/1999 |
| JP | 2005219443 | 8/2005 |

OTHER PUBLICATIONS

International Search Report. Date of Mailing Nov. 5, 2012.

* cited by examiner

*Primary Examiner* — Anh T. N. Vo
(74) *Attorney, Agent, or Firm* — Dhand Law PC

(57) ABSTRACT

In one example, a structure for supporting a printhead includes: a substrate having a first side and a second side; an inlet tower through which liquid may be introduced into the structure; an opening through the substrate near the inlet tower; and an air channel along the substrate connecting the opening in the substrate to the atmosphere.

11 Claims, 9 Drawing Sheets

VENT THROUGH A PRINTHEAD SUPPORT STRUCTURE

BACKGROUND

In some inkjet printers, the printheads are part of a discrete assembly separate from detachable ink containers in which ink is held in a block of foam or other capillary material. The ink holding chamber in these foam based ink containers is vented to the atmosphere through an opening in the top of the container. The container vent opening is sealed during storage and shipment to prevent evaporation from the ink chamber. The container vent is sometimes not functional when the container is installed in a printhead assembly, for example when the user fails to remove the vent seal. The printer will not print properly with a malfunctioning container vent.

DRAWINGS

The same part numbers designate the same or similar parts throughout the figures.

DESCRIPTION

A vent through the printhead assembly has been developed as an addition or alternative to the conventional vent on a detachable ink container. The new vent allows the container to supply ink to the printhead assembly even if the vent on the ink container malfunctions, for example if the user fails to remove the tape sealing the vent or if there is a defect in the vent that prevents air from reaching the ink chamber inside the container. In one example of the new vent, an air hole is formed through the substrate of a printhead support structure near the ink inlet so that the container ink outlet is exposed to the air hole when the container outlet is engaged with the ink inlet on the printhead assembly (i.e., when the ink container is installed on the printhead assembly). An air channel on the back side of the substrate connects the air hole to the atmosphere, thus venting the ink container to the atmosphere through the printhead assembly when the container is installed in the printhead assembly.

Examples of the new vent are described with reference to ink containers for an inkjet printer. However, examples of the new vent are not limited to ink containers, inkjet printers or inkjet printing. Examples of the new vent might also be implemented in other of inkjet type dispensers. The examples shown in the figures and described below, therefore, illustrate but do not limit the invention, which is defined in the Claims following this Description.

As used in this document, "liquid" means a fluid not composed primarily of a gas or gases; and a "printhead" means that part of an inkjet printer or other inkjet type dispenser that dispenses liquid from one or more openings, for example as drops or streams.

Figure 1:
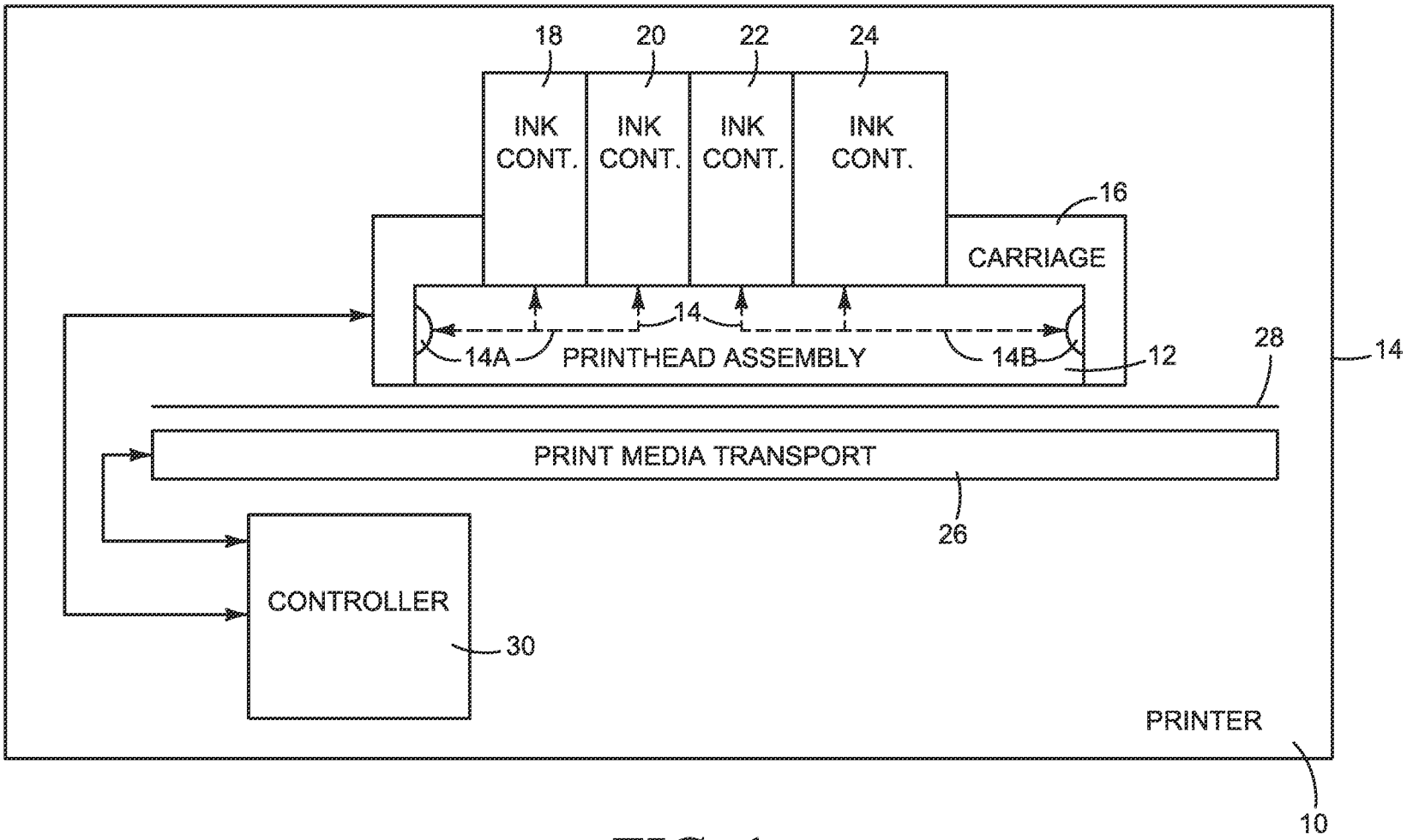
FIG. 1 is a block diagram illustrating an inkjet printer with a printhead assembly implementing one example of a new container vent.

FIG. 1 is a block diagram illustrating an inkjet printer 10 with a printhead assembly 12 implementing one example of a new container vent 14. FIGS. 2-9 Illustrate in detail one example of a printhead assembly 12 with a vent 14 such as might be used in the printer shown in FIG. 1. Referring first to FIG. 1, printer 10 includes a carriage 16 carrying printhead assembly 12 and detachable ink containers 18, 20, 22, and 24 that supply ink to printhead assembly 12. The interior, ink holding chamber of each container 18-24 is vented to the atmosphere through a vent 14 in printhead assembly 12. In the example shown in FIG. 1, container vent 14 consists to two separate vents 14A and 14B that vent ink containers 18, 20 and 22, 24, respectively. Other configurations for vent 14 are possible. For example, as described below a single vent 14 in printhead assembly 12 may be used to vent all of the ink containers 18-24.

Printhead assembly 12 includes one or more printheads through which ink from one or more containers 18-24 is ejected. A print media transport mechanism 26 advances a sheet of paper or other print media 28 past carriage 16 and printhead assembly 12. A controller 30 is operatively connected to carriage 16, printhead assembly 12 and media transport 26. Controller 30 represents generally the programming, processor and associated memory, and the electronic circuitry and other components needed to control the operative elements of printer 10.

Figure 2:
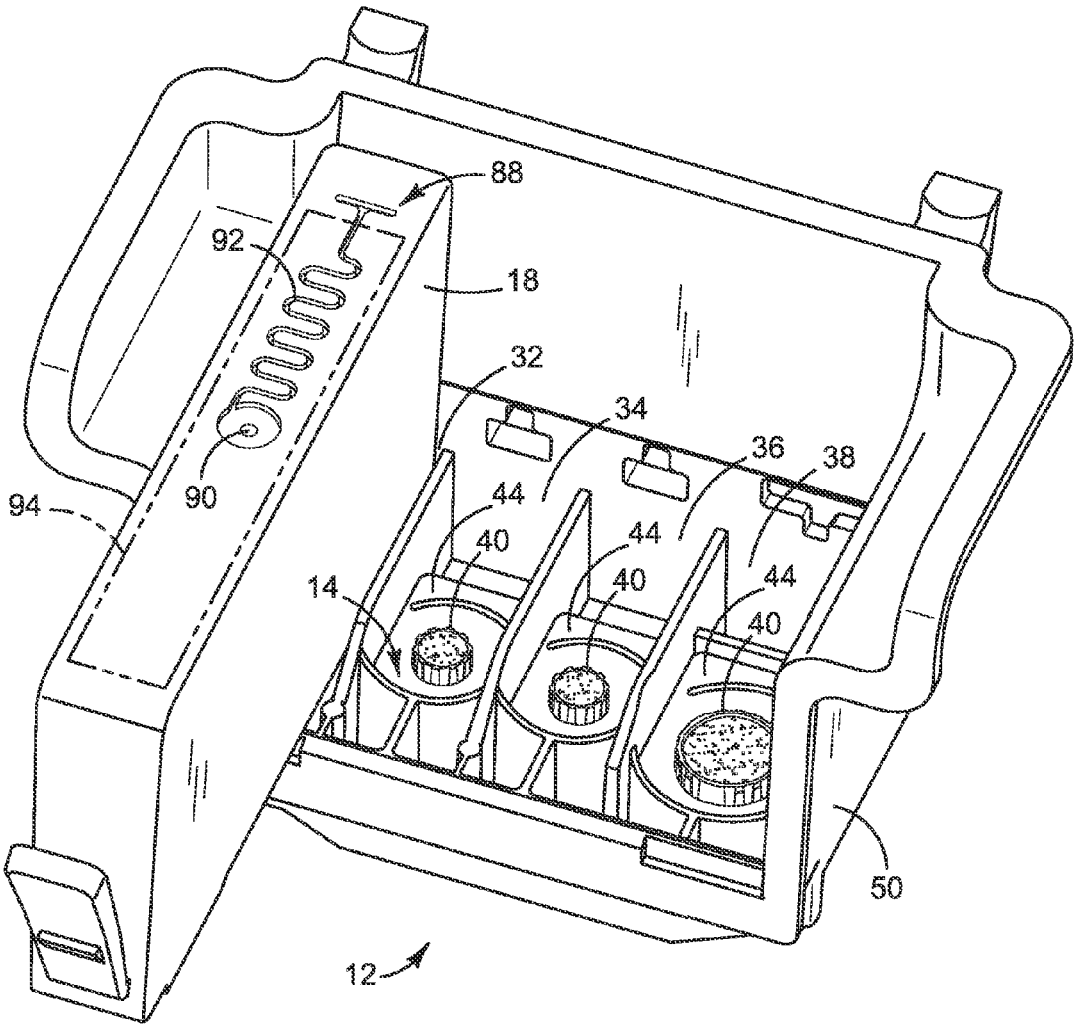
FIGS. 2 and 3 are perspective views illustrating a printhead assembly implementing one example of a new container vent.
Figure 3:
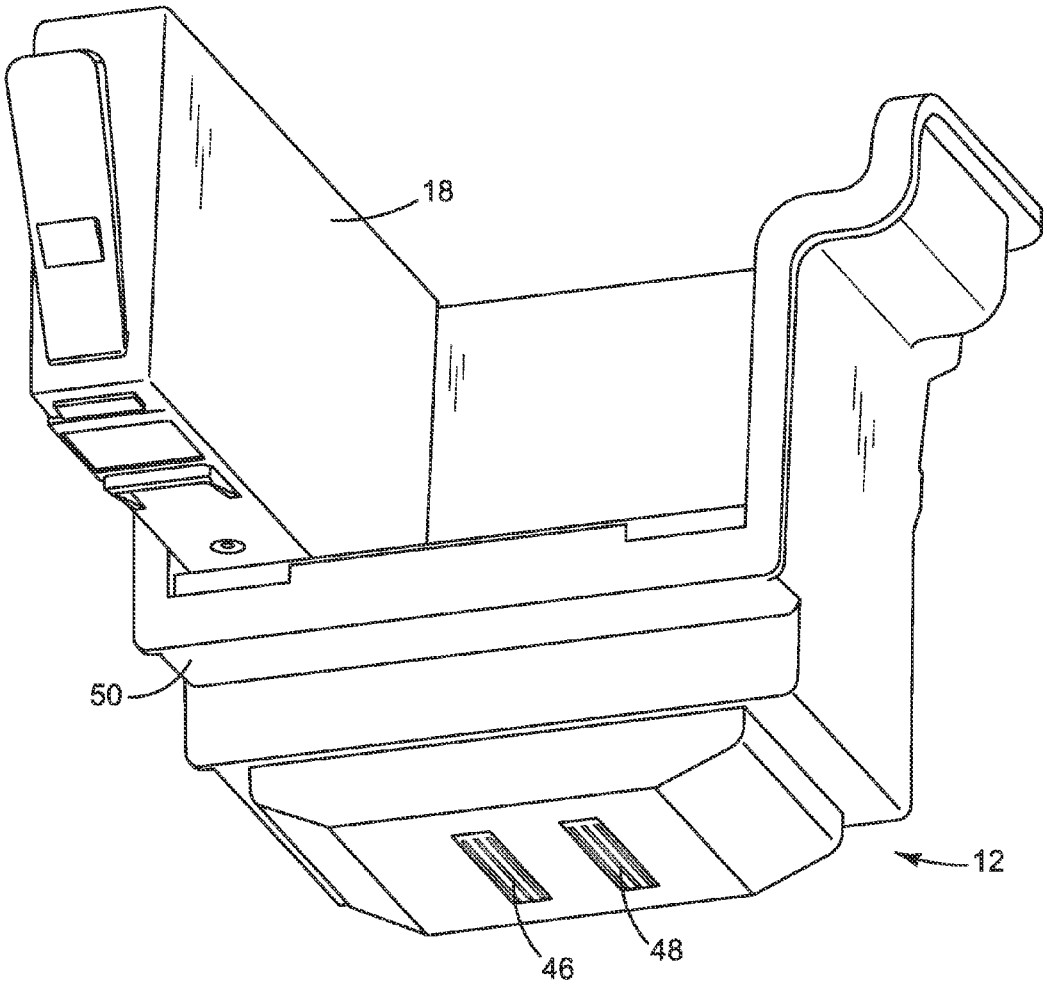

Referring now to FIGS. 2 and 3, printhead assembly 12 includes bays 32, 34, 36, and 38 for receiving detachable ink containers 18-24, respectively. Only ink container 18 is shown installed in printhead assembly 12 in FIGS. 2 and 3 to better illustrate some of the features of printhead assembly 12. Printhead assembly 12 includes ink inlets 40 for receiving ink from a corresponding ink outlet 42 (shown in FIG. 8) on each detachable ink container 18-24. Each ink inlet 40 is configured as a tower that is surrounded by an annular seal 44 that seals against the bottom of each container outlet 42 when the container is installed in printhead assembly 12. In the example shown, printhead assembly 12 includes two printheads 46 and 48. Ink from color ink containers 18-22, for example, is ejected from printhead 46 and ink from a black ink container 24 is ejected from printhead 48.

Figure 4:
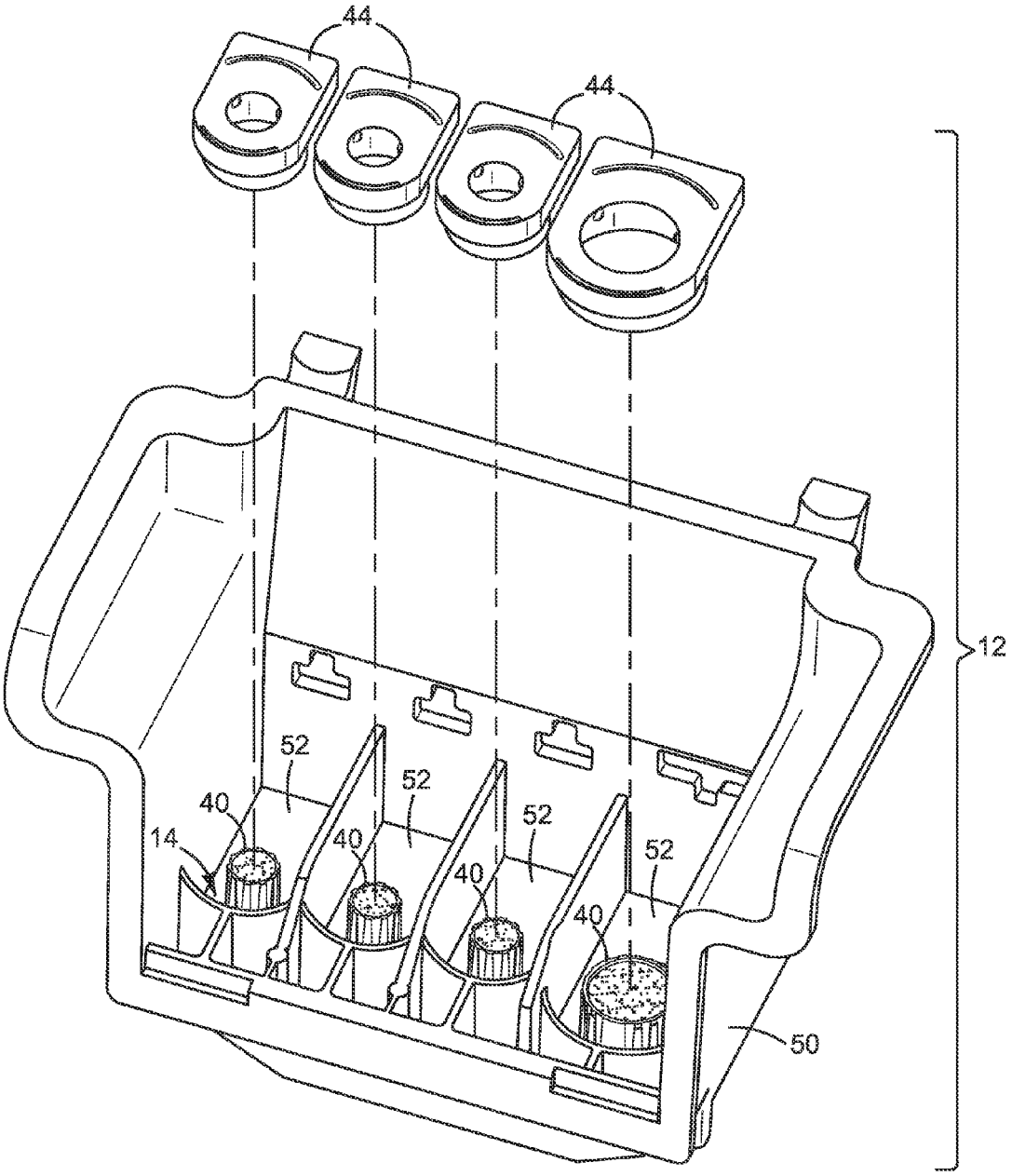
FIG. 4 is an exploded top side perspective view of the printhead assembly of FIGS. 2 and 3.
Figure 5:
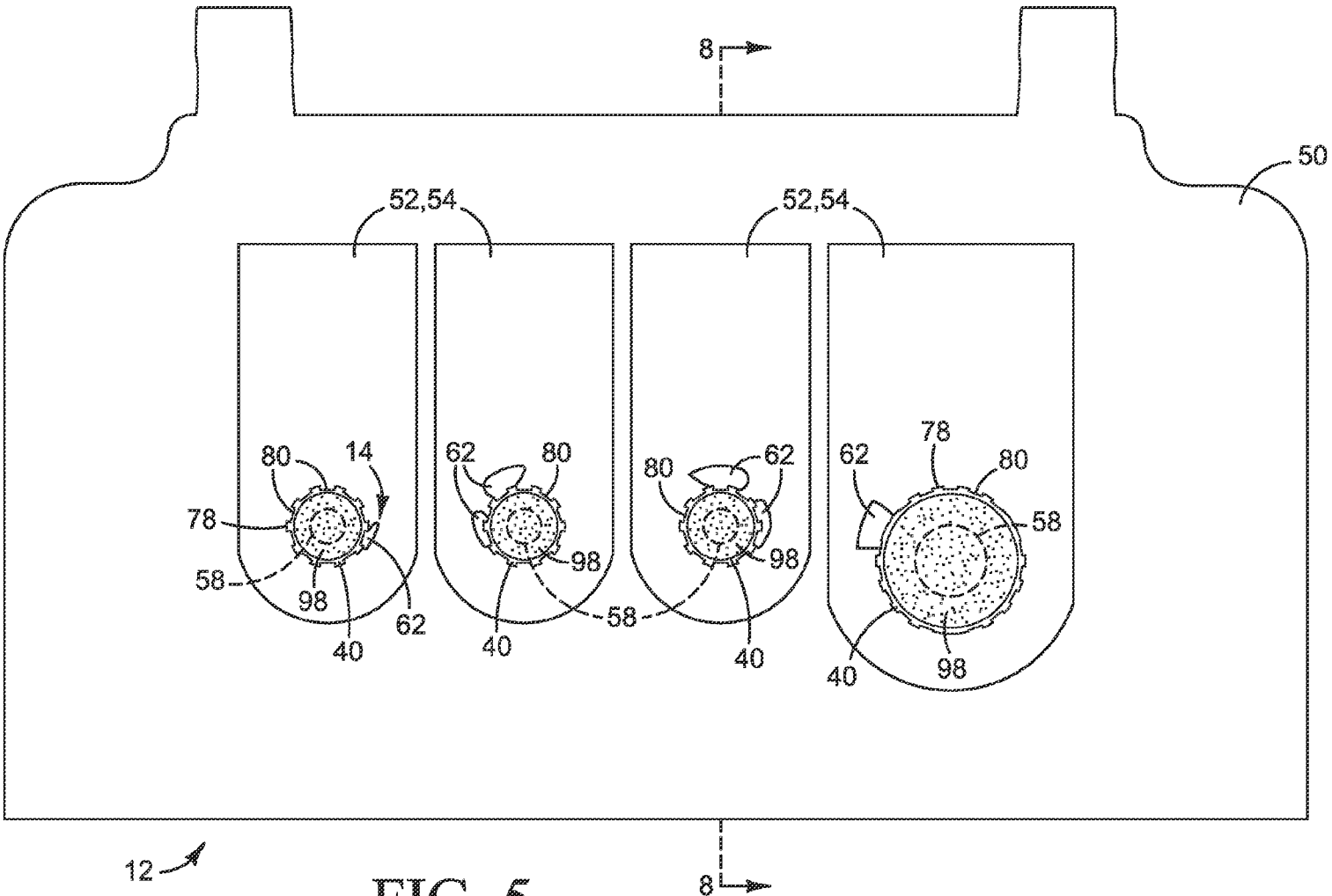
FIG. 5 is a top down plan view showing the printhead assembly of FIGS. 2-4 with the tower seals removed to expose the vent holes in the substrate of the printhead support structure.
Figure 6:
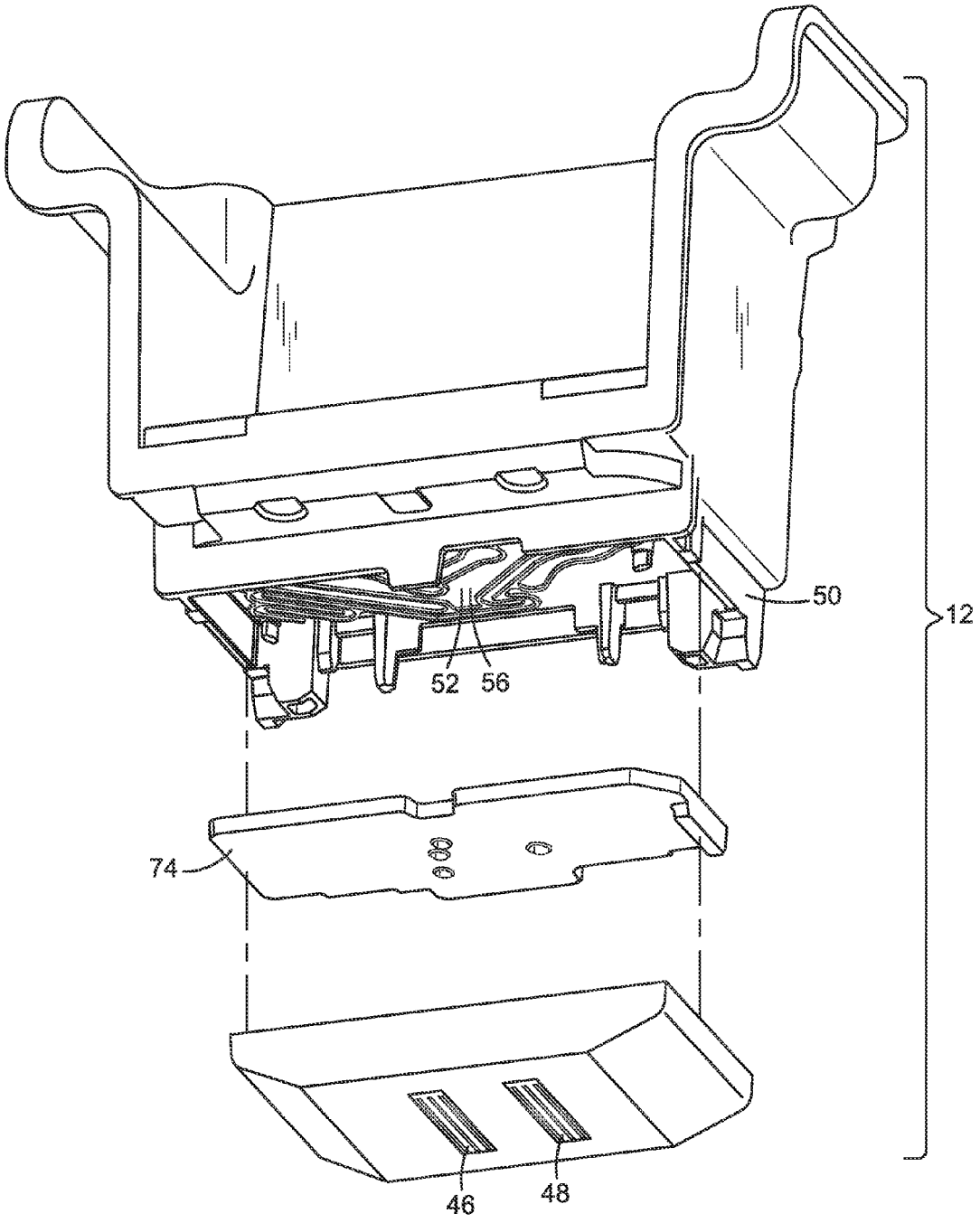
FIG. 6 is an exploded bottom side perspective view of the printhead assembly of FIGS. 2-5.
Figure 7:
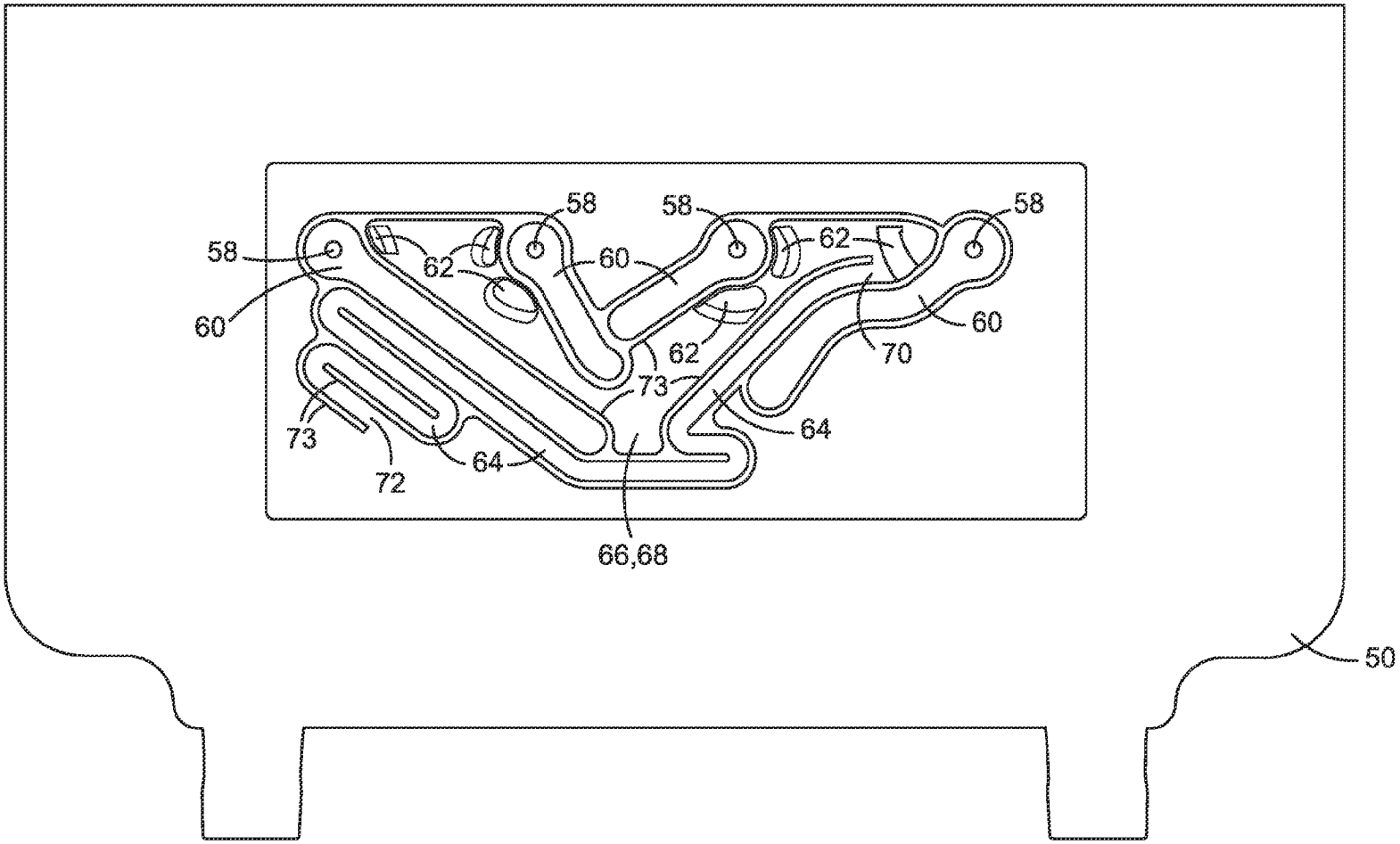
FIG. 7 is a bottom plan view of the printhead assembly of FIGS. 2-6 with the manifold cover removed to expose the air plenum and air channel along the underside of the printhead support structure substrate.
Figure 8:
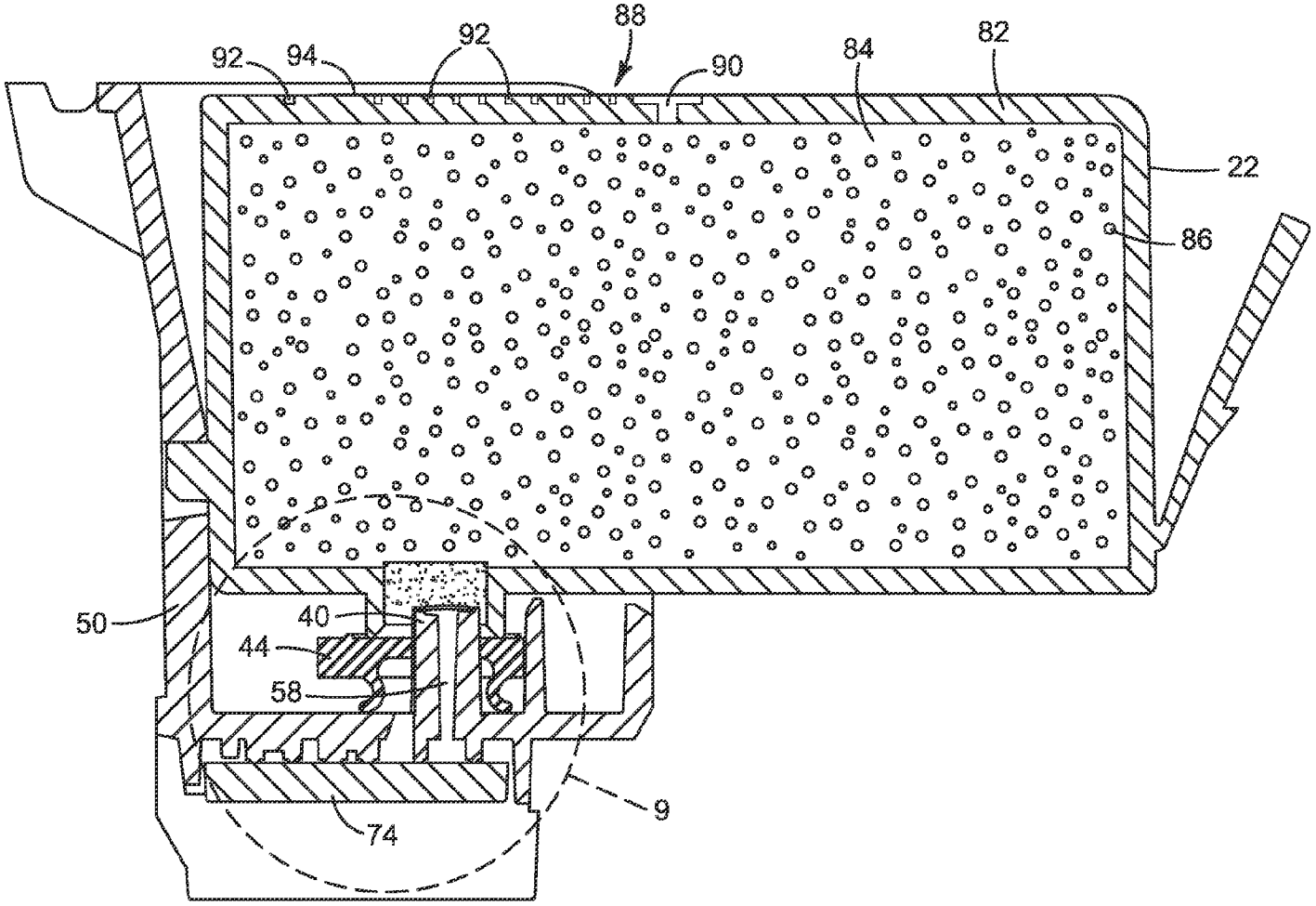
FIG. 8 is a section view of the printhead assembly of FIGS. 2-7 taken along the line 8-8 in FIG. 5 showing a vent path from the ink container outlet through the printhead assembly.
Figure 9:
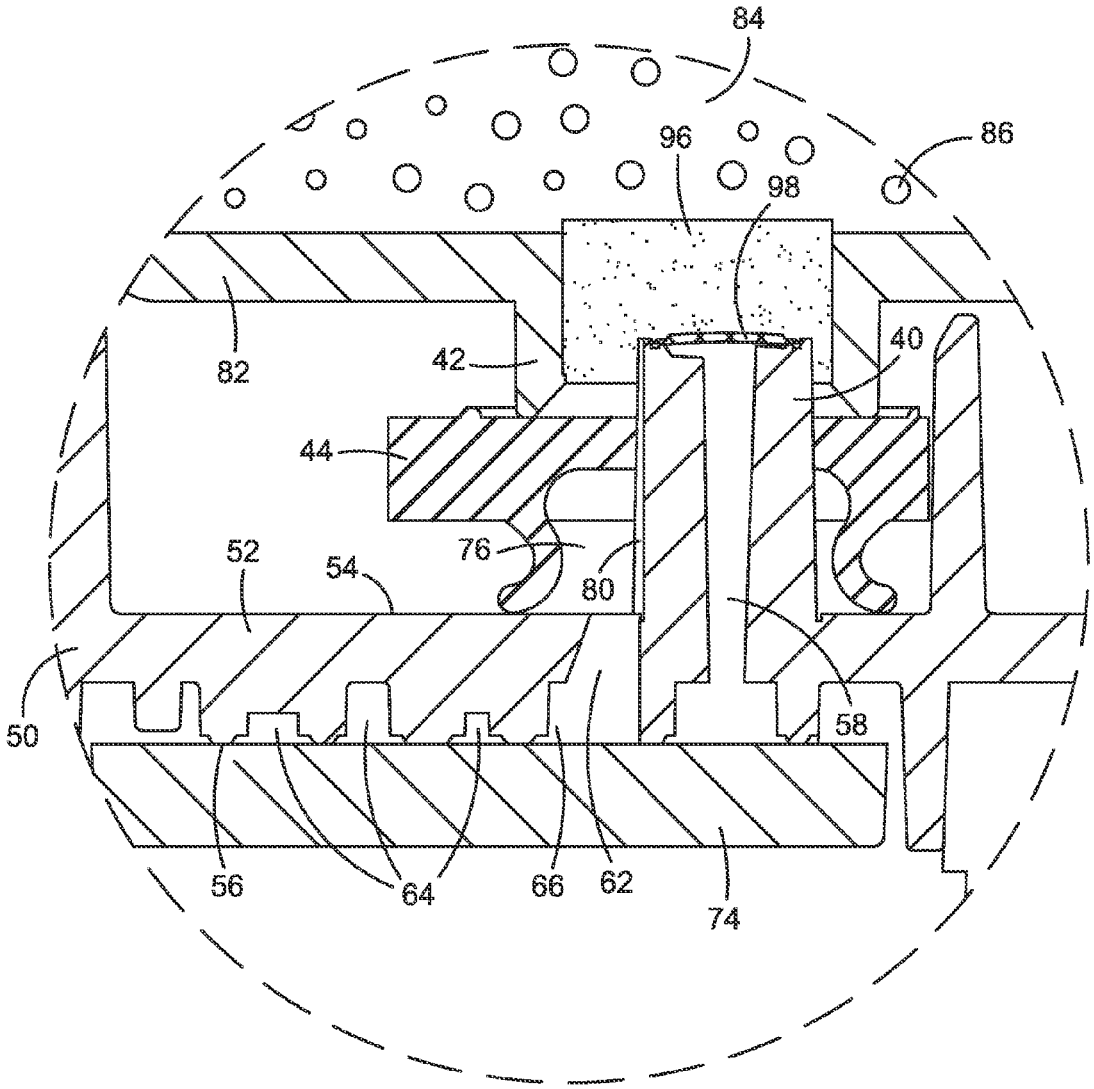
FIG. 9 is a detail view of the vent path shown in FIG. 8.

FIGS. 4 and 5 are exploded top side perspective and plan views, respectively, of printhead assembly 12. The inlet tower seals 44 are omitted in FIG. 5 to better illustrate vent 14. FIGS. 6 and 7 are exploded bottom side perspective and plan views, respectively, of printhead assembly 12. The printheads 46, 48 and the manifold cover are omitted in FIG. 7 to better illustrate vent 14. FIGS. 8 and 9 are section views showing vent 14 in more detail.

Referring to FIGS. 4-9, printhead assembly 12 includes a support structure 50 that supports printheads 46, 48 and other parts of printhead assembly 12. Ink inlet towers 40 protrude from a generally planar substrate 52 of support structure 50. While it is expected that printhead assembly 12 will usually be installed in a printer so that substrate 52 is horizontal during printing operations, as shown in the figures, a horizontal substrate 52 is not required. Indeed, substrate 52 alone or integrated into a printhead assembly 12 might have different orientations during manufacturing, packaging, storing, shipping, and printing. Ink inlet towers 40 protrude from a first side 54 of substrate 52. Printheads 46, 48 are mounted to a second side 56 of substrate 52 opposite first side 54. An ink hole 58 in substrate 52 inside each inlet tower 40 allows ink to flow through each container outlet 42 to printhead 46 or 48 along a corresponding ink channel 60 formed in the second side 56 of substrate 52. An air hole 62 in substrate 52 near each inlet tower 40 exposes each container outlet 42 to the atmosphere through an air channel 64 formed in the second side 56 of substrate 52.

In the example shown in the figures, a single air channel 64 vents all four containers 18-24 from an air plenum 66 that connects air holes 62 to air channel 64. Plenum 66 is defined by a single enclosed space 68 along substrate second side 56 enveloping air holes 62 as best seen in FIG. 7. One end 70 of air channel 64 is open to plenum 66 and the other end 72 is open to the atmosphere. Also, in the example shown in the figures, the walls 73 defining ink channels 60, air channel 64, and plenum space 68 are formed in second side 56 of substrate 52 and closed by a cover 74. That is to say, three sides of each enclosed space are formed in substrate 52 and the fourth side is formed by cover 74 affixed to substrate 52. Cover 74 is sometimes called a manifold or manifold cover because it helps define the ink distribution manifold formed by ink channels 60 in printhead assembly 12.

Each ink inlet tower 40 is surrounded by a seal 44. Referring specifically to FIGS. 8 and 9, the bottom of each container outlet 42 is pressed into a corresponding seal 44 to make a fluid tight seal that prevents air and ink from escaping between container outlet 42 and printhead assembly inlet 40. Seal 44 forms an interior cavity 76 surrounding at least part of inlet tower 40. Air hole 62 opens into cavity 76. The outer surface 78 of inlet tower 40 is recessed at the location of air hole 62 so that air can move from cavity 76 past seal 44 to container outlet 42. In the example shown, multiple recesses 80 are formed along outer surface 78 of inlet tower 42 to achieve the desired air flow between cavity 76 and container outlet 42.

Still referring to FIGS. 8 and 9, each ink container 18-24 includes a housing 82 that forms an interior chamber 84 for holding ink. For convenience, only ink container 22 shown in FIGS. 8 and 9 is called out in the following description. Ink in chamber 84 is held in foam or other suitable capillary material 86. A conventional vent 88 on container 22 vents ink chamber 84 to the atmosphere. A conventional vent 88 usually includes an opening 90 in container housing 82 and a small winding channel 92 covered by an adhesive label 94. (Label 94 is shown in phantom lines on container 18 in FIG. 2.) A wick 96 in container outlet 42 forms the fluidic interface between ink container 22 and printhead assembly 12.

When ink container 22 is installed in printhead assembly 12, as shown in FIGS. 8 and 9, wick 96 engages a corresponding inlet tower 40 on printhead assembly 12, for example through a filter 98, to establish the operative fluidic connection between ink container 22 and printhead assembly 12. When container 22 is installed in printhead assembly 12 but not vented correctly through vent 88, the flow of ink from container 22 into printhead assembly 12 during printing and priming would create to high a vacuum inside ink chamber 84, starving the printheads for ink. An extra container vent 14 through printhead assembly 12 allows air to pass around and through wick 96 into ink chamber 84 to maintain a correct pressure inside container 22 even if vent 88 fails.

Thus, for each ink container 18-24, vent 14 follows a path from opening 72 along air channel 64 to plenum 66, through air hole 62 in substrate 52 to cavity 76 between seal 44 and inlet tower 40, past inlet tower 40 in recesses 80 to wick 96 in container outlet 42. It is expected that in most implementations air channel 64 in printhead assembly 12, like air channel 92 on the containers, will be longer and smaller (in cross section) to help minimize evaporative losses through vent 14. Air holes 62 in substrate 52 and recesses 80 along net tower 40 may be sized and shaped to achieve the desired venting and, where appropriate, to facilitate manufacturing. (Printhead support structure 50 usually will be a molded plastic part.) Multiple smaller air holes 62 around an inlet tower 40, as shown in FIG. 5, may be used instead of a single larger hole as necessary or desirable to maintain the rigidity of inlet tower 40 to substrate 52.

As noted at the beginning of this Description, the examples shown in the figures and described above illustrate but do not limit the invention. Other examples are possible. Therefore, the foregoing description should not be construed to limit the scope of the invention, which is defined in the following claims.

What is claimed is:

1. A structure of for supporting a printhead, comprising:

a substrate having a first side and a second side, the first side including a bay to receive a container;

an inlet tower through which liquid may be introduced into the structure from the container, the inlet tower protruding from the first side of the substrate;

an opening through the substrate near the inlet tower from the first side of the substrate to the second side the substrate; and an air channel along the second side of the substrate connecting the opening in the substrate to the atmosphere, wherein:

the inlet tower comprises multiple inlet towers through which multiple liquids may be introduced into the structure, each inlet tower protruding from the first side of the substrate;

the opening comprises multiple openings each passing through the substrate near a corresponding inlet tower; and the air channel connects each opening to the atmosphere.

2. The structure of claim 1, wherein the air channel comprises a single air channel connecting all of the openings to the atmosphere.

3. The structure of claim 1, further comprising a single plenum along the second side of the substrate between the openings and the air channel, each opening opening into the plenum such that air may pass from the atmosphere along the air channel to the plenum and through the openings to the first side of the substrate.

4. A structure for supporting a printhead, comprising:

a substrate having a first side and a second side, the first side including a bay to receive a container;

an inlet tower through which liquid may be introduced into the structure from the container, the inlet tower protruding from the first side of the substrate;

an opening through the substrate near the inlet tower from the first side of the substrate to the second side the substrate;

an air channel along the second side of the substrate connecting the opening in the substrate to the atmosphere; and a seal surrounding the inlet tower to seal the outlet of a detachable liquid container against the structure when the container is attached to the structure, the seal forming a cavity surrounding the inlet tower on the first side of the substrate and the opening opening into the cavity; and gaps between the seal and the inlet tower to allow air to escape the cavity along the tower into the outlet of the detachable liquid container when the container is attached to the structure.

5. The structure of claim 4, wherein the gaps are formed by a series of recesses in an outer surface of the tower at an interface with the seal.

6. A printhead assembly, comprising:

a printhead to dispense ink; and a structure supporting the printhead, the structure including:

multiple ink inlets each to receive ink from a detachable ink container;

an ink manifold to distribute ink from the ink inlets to the printhead; and multiple vents each associated with one of the ink inlets to vent an ink container to the atmosphere through the printhead assembly when an ink container is attached to the ink inlet.

7. The printhead assembly of claim 6, wherein each vent includes a vent path that extends from one of the ink inlets to a single plenum common to all of the vent paths and then to an air channel connecting the plenum to the atmosphere.

8. The printhead assembly of claim 7, wherein the air channel comprises a single, winding air channel connecting the plenum to the atmosphere.

9. The printhead assembly of claim 6, further comprising a substrate having a first side and a second side opposite the first side, and wherein:

each ink inlet comprises an inlet tower protruding from the first side of the substrate;

the ink manifold comprises multiple ink channels along the second side of the substrate, each ink channel connected to a corresponding inlet tower through an ink opening in the substrate; and each vent comprises an air opening through the substrate near a corresponding inlet tower and an air channel along the second side of the substrate connecting the air opening to the atmosphere.

10. The printhead assembly of claim 9, wherein the air channel comprises a single aft channel common to all of the vents and each vent also includes a single plenum connected between each aft opening and the air channel.

11. The printhead assembly of claim 9, further comprising:

a seal surrounding each inlet tower to seal the outlet of a detachable ink container against the printhead assembly when the container is attached to the printhead assembly, each seal forming a cavity surrounding the corresponding inlet tower on the first side of the substrate with each air opening opening into the cavity; and gaps between each seal and the corresponding inlet tower to allow air to escape the cavity along the tower into the outlet of the detachable ink container when the container is attached to the printhead assembly.

* * * * *

UNITED STATES PATENT AND TRADEMARK OFFICE

CERTIFICATE OF CORRECTION

PATENT NO. : 9,254,672 B2
APPLICATION NO. : 14/373524
DATED : February 9, 2016
INVENTOR(S) : Iain Campbell-Brown et al.

It is certified that error appears in the above-identified patent and that said Letters Patent is hereby corrected as shown below:

Claims

In column 4, line 21, in Claim 1, delete "of for" and insert -- for --, therefor.

Signed and Sealed this
Twelfth Day of July, 2016

Michelle K. Lee

Michelle K. Lee
*Director of the United States Patent and Trademark Office*